US005114186A

United States Patent [19]

Sugiyama

[11] Patent Number: 5,114,186

[45] Date of Patent: May 19, 1992

[54] SHOCK ABSORBING SKI POLE

[76] Inventor: Kazuo Sugiyama, 8-20 3-chome, Sakurajosui Setagaya-ku, Tokyo, Japan

[21] Appl. No.: 695,857

[22] Filed: May 7, 1991

[51] Int. Cl.[5] ..... A63C 11/22

[52] U.S. Cl. ..... 280/821

[58] Field of Search ..... 280/821, 822, 823, 819

[56] References Cited

U.S. PATENT DOCUMENTS 3,797,845 3/1974 Kepka et al. ..... 280/821
4,061,347 12/1977 Stern et al. ..... 280/821
4,244,602 1/1981 Allsop et al. ..... 280/821

*Primary Examiner*—David M. Mitchell

*Attorney, Agent, or Firm*—David O'Reilly

[57] ABSTRACT

A ski pole that can accomplish the following capabilities: (1) absorb little shocks caused when the ski pole tip is thrust into snow, thereby protecting members of the human body and minimizing fatigue for short and long terms, (2) quick returning and removal from snow within hundreds of second (3) high thrusting capability of the pole tip into on ice bern, (4) minimum sticking of the pole tip to heavy or solid snow, (5) effective propelling action by the repulsing force of the bumping spring when of descending and sliding, thereby helping to shorten time, (6) workable depending on use and skill level of a skier in alpen descending and nordic sliding, and (7) safeness against dangers of falling, collision, and similar occasions.

16 Claims, 4 Drawing Sheets

SHOCK ABSORBING SKI POLE

BACKGROUND OF THE INVENTION

The present invention relates to a shock absorbing ski pole, and more particularly concerns a ski pole having spiral-reciprocally moving and buffering arrangements available to any skiers for safely and effectively in any kind of snow, descending and sliding in the alpen and Nordic styles.

There have been many prior disclosure about the ski poles, for example, in the Japanese Laid-Open Patents 53-128430 and 52-147131, the German Patent 2055597, the Sweden Patent 132429, and the U.S. Pat. No. 3,797,845.

However, the ski poles disclosed heretofore have the disadvantage in that they have problems of strength, durability, safeness, weight, balance, and mechanical simplification. They also have difficult problems because of the number of parts, production process, and cost.

The ski pole disclosed in the U.S. Pat. No. 3,797,845 has the disadvantage of the grip having the feature of vertical buffering only.

Useful ski poles have to meet the following important conditions. (1) Light weight. (2) Good balance. (3) High rigidity and durability. (4) Simple adjustability of the ski pole length in a sporting goods shop or by a skilled person. (5) Minimum shocks caused when ski pole tip is thrust into the snow, thereby protecting members of the human body and minimizing fatigue for a short and long terms. (6) Quick return and removal from snow within hundreds of second. (7) High thrusting capability of the pole tip into ice bern. (8) Minimum sticking of the pole tip to heavy or solid snow. (9) effective propelling action by repulsing force by the bumping spring when descending and sliding, thereby helping to shorten descent time. (10) Workable depending on use and skill level of a skier for alpen descending and nordic sliding. (11) Safe against the dangers of falling, a collision, and similar occasions.

Conventional ski poles can meet the above mentioned conditions (1) to (4). They, however, do not meet the conditions (5) to (11).

OBJECT OF THE INVENTION

In view of the foregoing, the present invention aims to achieve the following objects singly or in combination:

To provide ski pole conditions (5) to (11) mentioned above.

The ski poles of the present invention is constructed as described below with reference to the accompanying drawings. The ski pole has a new grip body 1 provided on a top thereof. Grip body 1 has three-dimensional positive motion cam 4 cut out thereon which forms a cam mechanism together with a driving bolt pin 11. The cam mechanism can drive shaft head 7 and pipe shaft 6 in a spirally reciprocal movement. It also serves to reinforce pipe shaft 6 having a thin and weak wall to the same strength and durability as the usual poles with the shaft head 7 and driving bolt pin 11. Grip body 1 has a cushion stably held therein as effective buffer.

SUMMARY OF THE INVENTION

In operation, the ski pole according to the present invention meets the above mentioned eleven requirements.

(1) Light weight. The ski pole of the present invention is heavier than a conventional pole as it have four additional parts, including rubber-like cushion 8, long compression coil spring 9, short compression coil spring 10, and driving bolt pin 11, as shown in FIG. 8. Each of these parts, however, weigh only a few or several grams. Shaft head 7 and grip body 1 are a little larger than usual. But the total weight is only short compression coil spring 10 to 20 g heavier than usual, making it feel rather light to a user.

(2) Good balance. As the above mentioned extra weight is all concentrated in grip section 2, the overall balance is ideal. It feels light at its tip to a user when the sky pole is swung forward.

(3) High rigidity and durability. These are accomplished by the structure of grip body 1, including pipe shaft retaining section 3, grooves of three-dimensional positive motion cam slot 4, and inside concave cavity 5, and with members, including shaft head 7 and driving bolt pin 11.

It is a concern that as the cam mechanism is used, driving bolt pin 11 may come loose, and thin, weak pipe shaft 6 may twist and break down. These problems are overcome by driving bolt pin 11 being tightly screwed in until its large head stops to serve as a nut so that shaft head 7 can be tightly inserted into pipe shaft 6 made of viscous resin.

Rubber-like cushion 8 inserted and fixed in upper hole of shaft head 7 may be compressed to a maximum limit to the top end of inside concave cavity 5 when the ski pole is thrust into snow with the strongest impact. Long compression coil spring 9 and the short compression coil spring 10 can have allowances adjusted according to the length of projection of shaft head 7 so that they cannot reach their maximum compression. The head of driving bolt pin 11 can be adjusted to length so that it cannot reach the top ends of cam groove 4.

A reason for this design is that when the maximum compression load is exerted to the pipe shaft 6, it is born by the top of the inside concave cavity 5 through shaft head 7 and rubber-like cushion 8. The design protects long compression coil spring 9, short compression coil spring 10, and driving bolt pin 11 so that their durability is increased.

(4) Simple adjustability. The length of the ski pole can be adjusted by disassembling the ski pole and cutting off the end of pipe shaft 6 to a desired length. For assembling, screw hole 18 for to fit driving bolt pin 11 is bored in shaft head 7 while pie shaft 6 is fitted in a simple jig as shown in FIG. 7. It is preferable to provide the jib in a sporting goods shop in advance.

(5) Little shocks. This is accomplished by the ski pole having long compression coil spring 9 always compressed and holding driving bolt pin 11 at the bottom of three-dimensional positive motion cam slot 4 through shaft head 7 when not in use. With the ski pole is thrust into the snow, the buffering function can occur in a three stage way of long compression coil spring 9 acting loosely first, then acting in cooperation with short compression coil spring 10 on the way, and they act strongly together with rubber-like cushion 8. The ski pole can be pulled out with the strong repulsive force of the springs.

Witch use of grip body 1*a*, which will be described later in embodiment 2, an additional one or two buffering features are provided for further complicated buffering effect.

It is difficult to accurately measure the multi-stage spring effect to protect the body a skier. But, the impact when the ski pole was thrust into a cedar board was measured in a room with an impact sensor attached at the shoulder joint of an adult skier of higher class, assuming he descends in the weldern style at a speed of 30 km per hour on a slope of 28 degrees. Results were around 2.5 G average for a conventional ski pole and 1.5 G for embodiment 1 of the present invention which will be described later. As a reference, the impact exerted to a knee joint of a marathon runner was 6.5 G at 20 km per hour, and that of a bicycle driver was 0.6 G only.

(6) Quick return and removal from snow. It is one of the most important conditions for the ski pole to return and be removed from snow as quick as possible, particularly for the high class skier in the weldern and competition on a steel slope. It has to be made within hundreds of second. This can be decisively accomplished by the last stage of the buffering effect of the instant strong three-stage spring repulsion described in condition (5) above.

(7) High thrusting capability of the pole tip into an ice bern. The degree of the ski pole tip thrusting into the ice bern is determined by the spiral reciprocal movement of pipe shaft 6. With the alpen descending method, the right and left hands of skier have to be turned right and left when the ski pole is thrust. This is achieved with the ski pole of the present invention by adjusting the direction of slope of the three-dimensional positive motion cam 4 described in embodiment 3 below.

(8) Minimum sticking of the pole tip to heavy or solid snow. This also is accomplished with the ski of the present invention by the spiral reciprocal movement of pipe shaft 6 as in the case of condition (7) above.

(9) Effective propelling action by the repulsing force of the bumping spring in any descending and sliding action. The repulsing force is obtained by the natural returning motion of the buffering mechanism described in condition (5) above. It is particularly important that the strongest repulsion is caused by the initial stage of the combined three-stage reaction.

(10) Workable depending on use and skill level of a skier in alpen descending and nordic sliding. This is accomplished by adjusting the angles of cam 4, length of the grooves, and action of the springs.

(11) Safeness against the dangers of a fall, collision, and in similar occasions. The ski pole is safer than conventional poles as the multi-stage buffering mechanism starts with soft thrusting moves to hard, gradually, and then returns instantly from hard to soft.

The above and other features and advantages of the invention will be more fully understood from the following detailed description and the accompanying drawings, in which:

DESCRIPTION OF PREFERRED EMBODIMENTS

Embodiment 1

Figure 1:
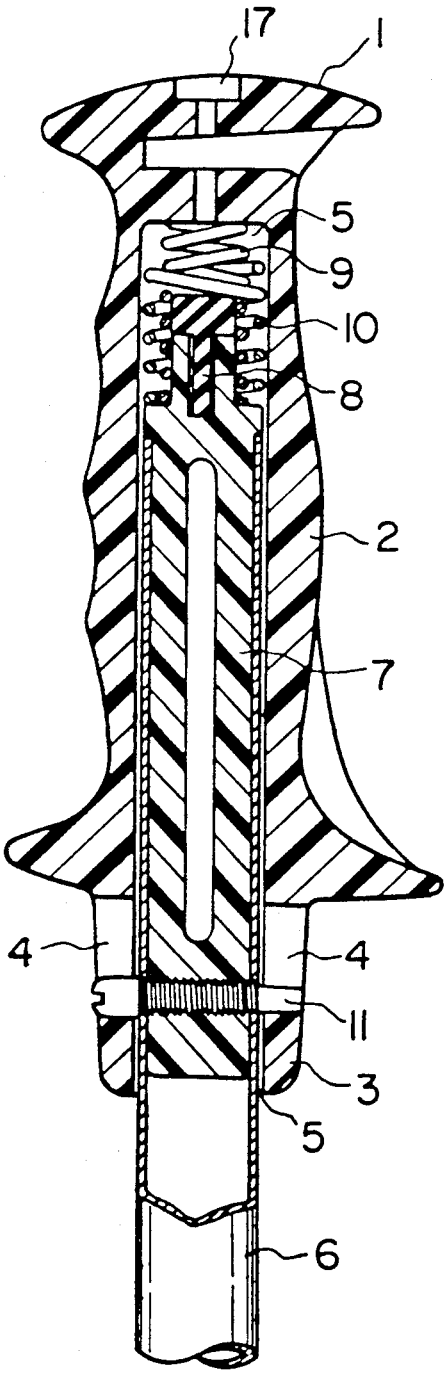
FIG. 1 is a cross sectional view illustrating the grip body actual size in a first embodiment of the ski pole of the present invention in which right half part is a cross section taken along line A O'A' of FIG. 2 and the left half part is a cross section along line A O A' of FIG. 2.
Figure 2:
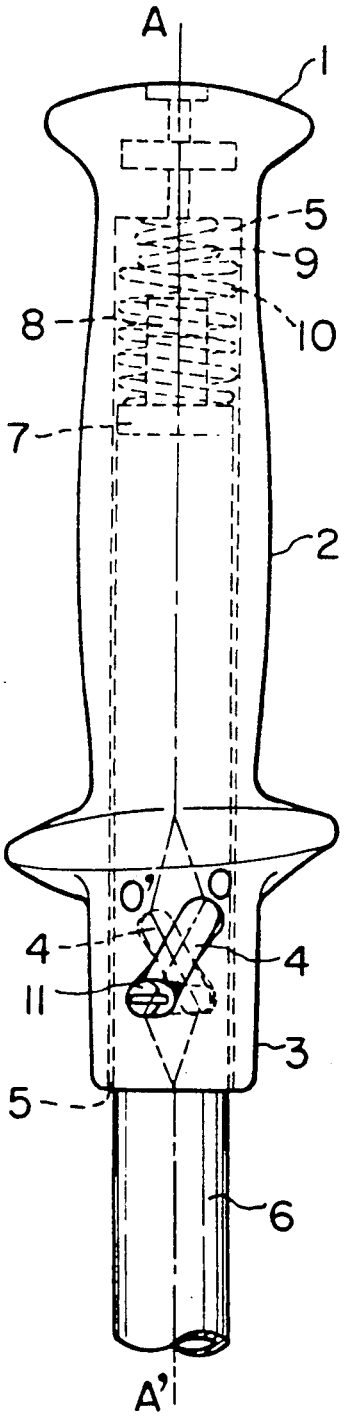
FIG. 2 is a perspective view of the grip body actual size taken on a longitudinal line as shown in the figure section line A O' A'.
Figure 3:
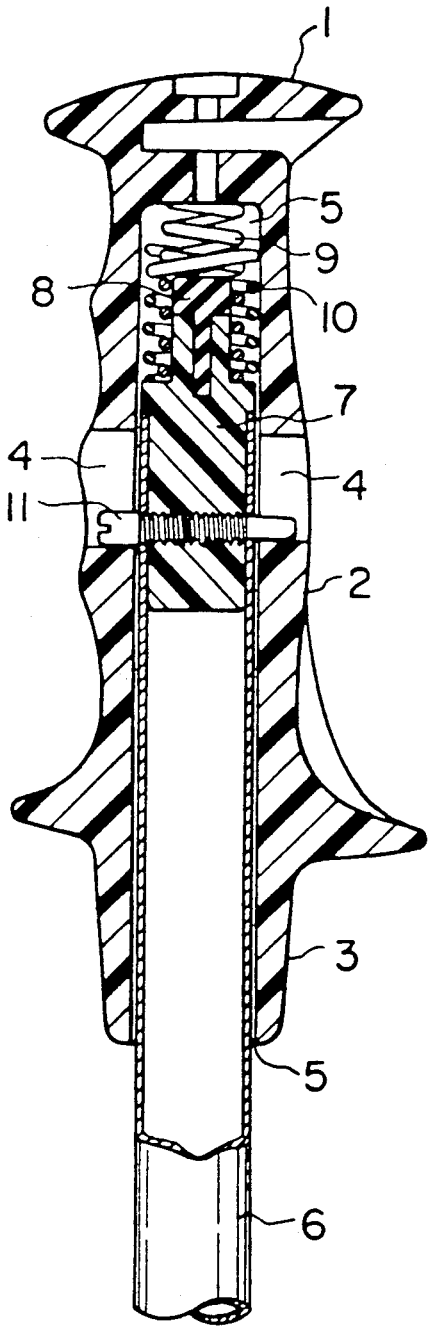
FIG. 3 is another cross sectional view illustrating the grip body in which the three-dimensional positive motion cam slots are provide d on the higher up on the grip body with cross section at hole 4 being similar to the cross section in FIG. 1.
Figure 5:
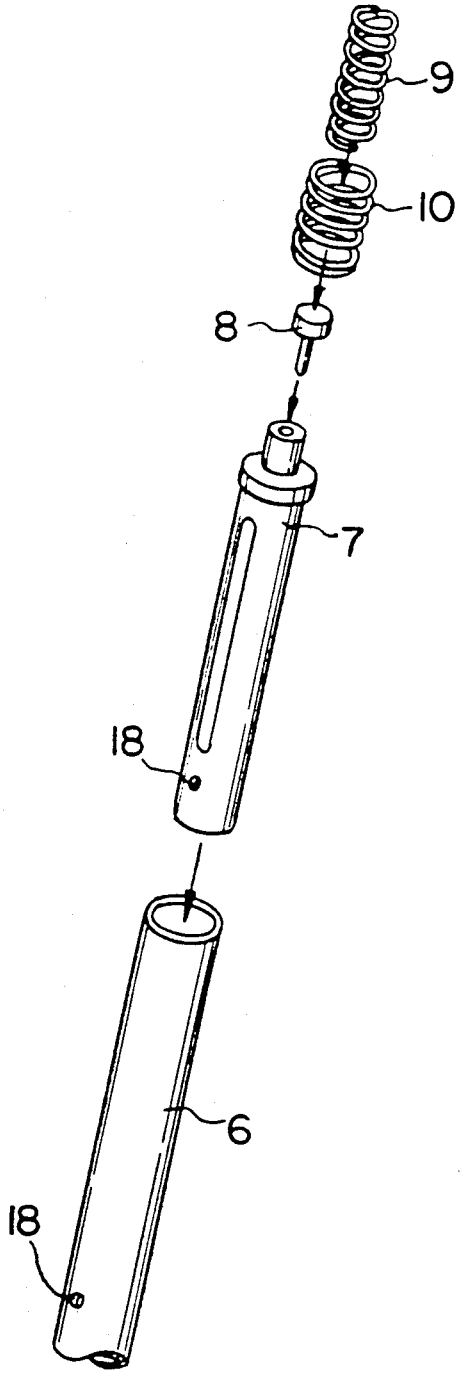
FIGS. 5 and 6 are sketches illustrating assembly of the ski pole of the present invention.
Figure 6:
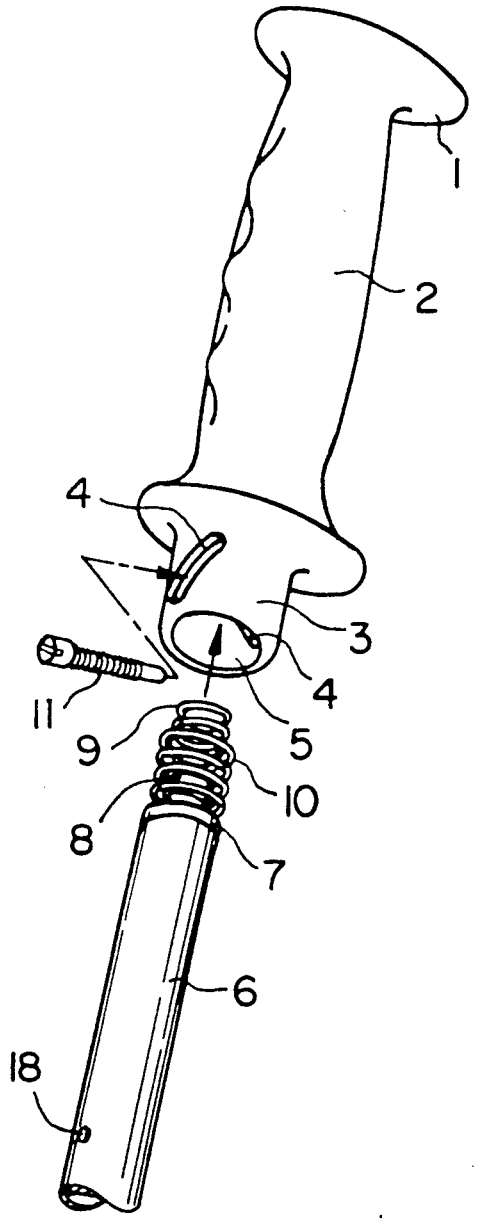
Figure 7:
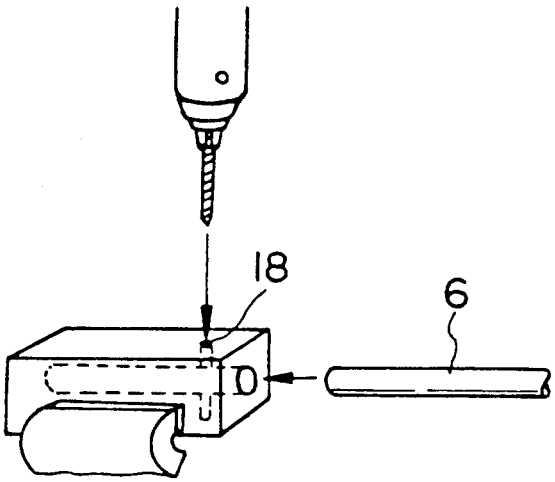
FIG. 7 is an illustration for adjusting the length of the pipe shaft of the ski pole.

The ski pole in the first embodiment according to the present invention, as shown in FIGS. 1, 2, and 3, comprises grip body 1, pipe shaft 6, and pole ring section 19. Grip body 1 is integrated with the other functional members, including grip section 2, pipe shaft retaining section 3, three-dimensional positive motion cam slot 4, and inside concave cavity 5. The inside of concave cavity 5 holds the moving members that reciprocate spirally. Shaft head 7 in pipe shaft 6, as shown in FIGS. 5 and 6, has rubber-like cushions 8 inserted in a hole in a projection at the top thereof. The projection receives long compression coil spring 9 and short compression coil spring 10 installed in the sequence shown. These, as shown in FIG. 6, are inserted into inside concave cavity 5 of grip body 1 until they are stopped by the upper end of concave cavity 5 in grip body 1.

In turn, grooves in three-dimensional positive motion cam slot 4 of grip body 1 are aligned with screw hole 18 to receive driving bolt pin 11 which has three sections of different diameter, the middle section having threads. Driving bolt pin 11 is screwed into three-dimensional positive motion cam 4 and screw hole 18, beginning with its thinner section, until its thicker head section is stopped. This completes assembling of the ski pole.

Embodiment 2

The ski pole in a second embodiment of the present invention is constructed in a multi-stage combination of two or more members to further increase the buffering effect, while the first embodiment was of the integration type.

Figure 4:
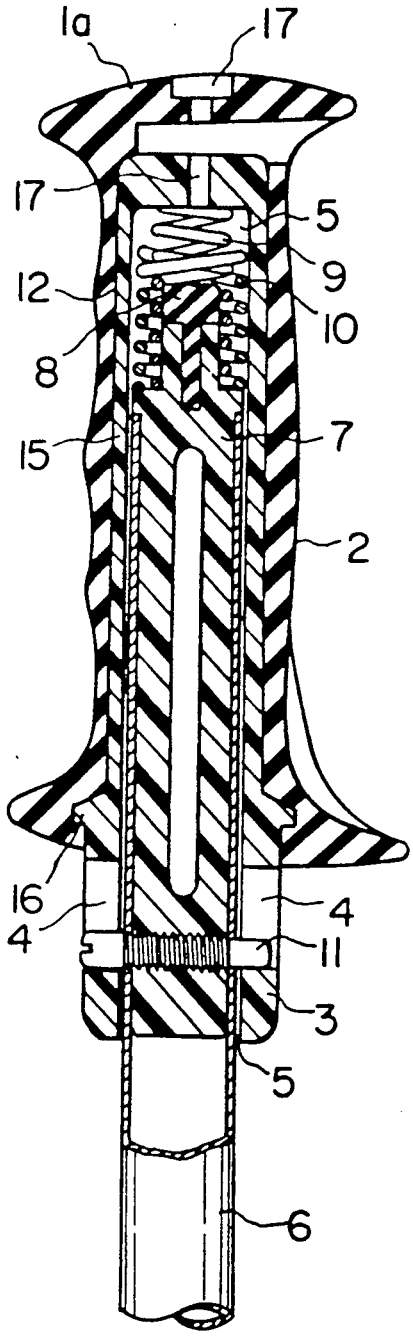
FIG. 4 is a cross sectional view illustrating the grip body actual size in a second embodiment of the ski pole of the present invention in which right half part is a cross section taken along line A O'A' in FIG. 2 and the left half part is a cross section taken along line A O A' in FIG. 2.

FIG. 4 is grip body 1*a* of the second embodiment. Grip body 1*a*, made of a buffering material such as rubber, has an outside grip section 2, second inside concave cavity 5B, and head bolt hole 17 at the top thereof. Grip body 1*a* has an inner cylinder 15 inserted in cancave cavity 5B. The inner cylinder 15 has pipe-shaft retaining section 3, three-dimensional positive motion cam slots 4, and inside concave cavity 5 formed, and is made from a hard substance. It has a metallic mold (not shown) fitted to grip body 1*a*, and has a buffering substance filled in to form it.

Both substances can be selected or combined so that the grip body 1*a* and the inner cylinder 15 can be bonded together or alternatively separated. The former serves as one-stage buffer, and the latter as two-stage buffer. In this, grip body 1*a* and inner cylinder 15 are bolted through with head bolt hole 17 at the top end of grip body 1*a*. In addition, they are completely held together by grip fixing projection 16 of inner cylinder 15 to further increase the multi-stage buffering effect.

Embodiment 3

In grip body 1 and grip body 1*a* of the above mentioned two examples, integration and combination constructions, upper and lower sides of the two grooves of the three-dimensional positive motion cam slot 4 are always made perpendicular to the inside concave cavity 5 and slanted as shown.

The angles of the grooves are preferably between 0 and 75 degrees, and the length of the grooves is preferably short with a compression coil spring of 10 to 70 mm by which pipe shaft 6 can be spirally moved when the ski pole is thrust. The grooves can be formed at any position of pipe shaft 6 below its practical upper limit.

The three-dimensional positive motion cam slot 4 can be made to change depending on the style, descending or sliding, and the technical level of a skier. This leads to a change of strength and quantity of buffering cushions and functions, dimensions, and shapes of shaft head 7, pipe shaft retaining section 3, and driving bolt pin 11.

Figure 8:
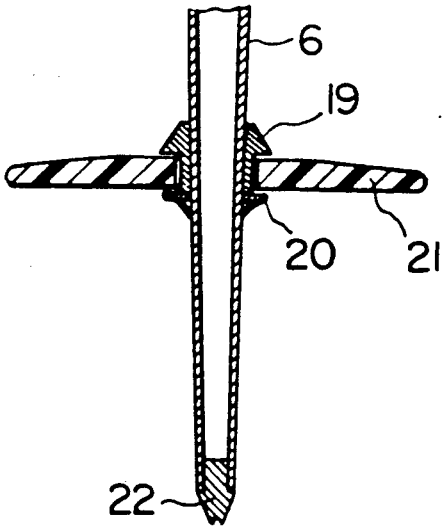
FIG. 8 is illustrates mounting of a ring section on the end of the ski pole to minimize sticking in heavy or solid snow.

FIG. 8 illustrates the mounting of a ring section 21 on a lower end of pipe shafy 6. Ring section 21 is rotatably mounted. Pipe shaft 6 between upper mounting plate 19 and lower mounting plate 20 with the end sealed by tip 22. The ring section 21 minimizing sticking of the pole trip to heavy or solid snow.

It is to be understood that the form of the present invention herewith shown and described is to be taken as a preferred embodiment. Various changes may be made in the shape, size and arrangement of parts. For example, equivalent elements may be substituted for those illustrated and described herein, parts may be reversed, and certain features of the present invention may be utilized independently of the use of other features, all without departing from the spirit of scope of the present invention as defined in the subjoined claims.

What I claim is:

1. A ski pole comprising a grip body, a pipe shaft having two holes for inserting a driven screw pin, and a ring section, wherein the grip section is made of a grip, a pipe shaft retaining section, a first inside concave cavity allowing said pipe shaft to move and holding it, and said pipe shaft having a shaft head inserted therein and held at a head end thereof, said pipe shaft with said shaft head having two holes threaded there through for inserting said driven screw pin, a rubber-like cushion on an upper end of said shaft head, a long compression coil spring, and a short compression coil spring installed over said shaft head, said pipe shaft and shaft head with said compression spring being inserted into said concave cavity to the head end thereof, said retaining shaft including: three dimensional positive motion cam means comprising, two grooves to receive said pin and connect said grip section and said pipe shaft so as to allow their relative movement vertically and rotationally about the ski pole axis.

2. A ski pole according to claim 1, characterized by an integration and buffering structure in which said whole grip body is integrated on two or more members and materials to provide multiple buffers including an outer buffering grip of damping material, said buffering grip having a second inside concave cavity and a head screw hole, said second inside concave cavity having an inside cylinder provided therein, said inside cylinder of hard material having a pipe shaft reinforcing section each of said grooves comprising a vertically and radially extending slot, said second inside concave cavity, and a grip fixing projection, said inside cylinder being formed in said buffering grip body.

3. A ski pole according to claim 1, in which the two grooves of said three-dimensional positive motion cam slot can cut at right angles to an inner cylinder of the inside concave cavity at anytime each, one being positioned opposite to the other, or 180 degrees apart, and said grooves being symmetric about a center line of said inside concave cavity.

4. A ski pole according to claim 2, wherein said buffering grip body and said inside cylinder being bonded together.

5. A ski pole according to claim 2, said buffering grip body having a second inside concave cavity and being separately joined to said inside cylinder with a screw through a head screw hole and being held on said projection.

6. A ski pole according to claim 1 characterized by a ring section rotatably mounted on the end of said pipe shaft opposite said hand grip between upper and lower ring mounting plates.

7. A ski pole according to claim 2, characterized by a ring section rotatably mounted on the end of said pipe shaft opposite said hand grip between upper and lower ring mounting plates.

8. A ski pole according to claim 2, in which the two grooves of said three-dimensional positive motion cam slot can cut at right angles to an inner cylinder of the inside concave cavity at anytime, each one being positioned opposite to the other, or 180 degrees apart, and said grooves being symmetric about a center line of said inside concave cavity.

9. A shock absorbing ski pole comprising: a handle grip body; having a concave cavity; a pipe shaft fitting said concave cavity; a shaft head on one end of said pipe shaft inserted in said concave cavity; cam slot means extending both vertically and radially on said handle grip body; pin means passing through said cam slot means, said pipe shaft and said shaft head, said pin means movable in said cam slot means for securing said pipe shaft and shaft head in said handle grip body and allowing vertical and radial relative movement therebetween; resilient cushioning means on the end of said shaft head opposed to the interior end of said concave cavity; a pair of concentric coil springs between the end of said shaft head and said concave cavity; one of said springs being longer than the other; whereby said pipe shaft and shaft head are slidable and rotatable in said handle grip against the compression force of said coil springs.

10. The ski pole according to claim 9 in which said shaft head has a shoulder; said pair of coil springs being mounted on said shoulder; the inner concentric coil spring being longer than the outer concentric coil spring; whereby said concentric springs provide double buffering for small and large shocks.

11. The ski pole according to claim 9 in which said cam slot means comprises a pair of angled slots on opposite sides of said handle grip body.

12. The ski pole according to claim 11 in which said pin means comprises a threaded pin; said shaft head having a threaded hole; said pin means being inserted into said threaded hole in said shaft head.

13. The ski pole according to claim 12 in which said pin means has a head portion larger than the threads seated in one of said cam slots and a smooth shank portion seated in the other of said cam slots.

14. The ski pole according to claim 9 in which said handle grip body is comprised of an outer resilient grip section and an interior tubular cylinder having a concave cavity.

15. The ski pole according to claim 14 in which said grip section and inner cylinder have holes in upper ends for bolting them together.

16. The ski pole according to claim 14 in which said inner cylinder has a pipe retaining section on a lower end; said cam slot means being in said pipe retaining section.

* * * * *